United States Patent [19]

Gibson

[11] Patent Number: 4,976,298

[45] Date of Patent: Dec. 11, 1990

[54] ANTI-KICKBACK HOLD DOWN DEVICE

[75] Inventor: Jeremy H. Gibson, Eastlake, Ohio

[73] Assignee: Leichtung Inc., Cleveland, Ohio

[21] Appl. No.: 524,784

[22] Filed: May 17, 1990

[51] Int. Cl.[5] ..... B27C 1/12

[52] U.S. Cl. ..... 144/249 B; 83/431; 83/446; 144/242 C; 144/247

[58] Field of Search ..... 83/418, 431, 446, 448; 144/242 C, 247, 249 R, 249 B

[56] References Cited

U.S. PATENT DOCUMENTS

| | | | |
|---|---|---|---|
| 1,278,814 | 9/1918 | Johnson | 144/249 R |
| 2,125,919 | 8/1938 | Harris | 144/249 R |
| 2,687,153 | 8/1954 | Moore | 144/247 X |
| 2,817,376 | 12/1957 | Johannsen | 144/249 R |
| 3,738,403 | 6/1973 | Schwoch et al. | 144/242 C |

FOREIGN PATENT DOCUMENTS

| | | | |
|---|---|---|---|
| 576428 | 5/1958 | Italy | 144/242 C |

*Primary Examiner*—W. Donald Bray
*Attorney, Agent, or Firm*—Frank B. Robb

[57] ABSTRACT

An anti-kickback and hold down device having provision for mounting on and removal from a saw availed of for ripping material, primarily wood, and including a spring pressed wheel to engage the material being ripped, thus enabling ripping of wood of widely varying thickness, and preventing reverse movement of the wood caused by the saw itself, and effected by ratchet elements controlling the wheel operation, which are able to be positioned in varied longitudinal alignment, as well as to release or disable the ratchet at will, axial alignment of the wheel providing for holding the material being ripped, against a fence or like guide during the ripping operation.

9 Claims, 2 Drawing Sheets

ANTI-KICKBACK HOLD DOWN DEVICE

BACKGROUND OF THE DISCLOSURE

In woodworking in general, it is often desirable to provide for ripping a substantial number of pieces of wood, and of varying thicknesses, the ripping operation usually being accomplished by a circular saw, which in turn has a tendency to kickback so, to speak, the material being ripped as the ripping operation is performed.

Additionally, it is usually the case that the ripping operation is performed with a rip saw arranged with a fence, against which the material is desirably held, and to that end some means are preferably provided to maintain such positioning of the material being ripped during that operation.

Also under some circumstances where the kickback tendency is of no material effect, the ripping operation may be performed without the kickback elements being in place and thus perhaps at some greater speed and in other cases with somewhat more ease than otherwise is the case.

There are several approaches to the concept of anti-kickback ripping arrangements and a number of devices on the market, which provide for that situation, but most of them are considerably more complicated than is necessary under most circumstances.

THE PRIOR ART

The prior patented art is only known to me to the extent of U.S. Pat. No. 3,738,403, which is directed to a device found in the same art as the device of my invention, but is of considerably greater cost to produce since it involves heavy castings, a spring construction and lever arrangement which is quite difficult to operate since it involves a strong spring, a special form of wheel to engage the material being ripped and involving in it a one way operation which cannot be changed without reversing the entire apparatus and thus defeating the purpose thereof.

It is also true that this particular device is intended to be mounted in some way, but usually permanently and thus in that sense not as facile as the device of my invention.

GENERAL DESCRIPTION OF THE INVENTION

My invention generally involves the provision of certain means for mounting the device adjacent a saw, in this case primarily in connection with a fence of a saw which effects the ripping action of woodworking operations, the hold down arm which is connected to this mounting means, is pivotally connected in a manner that makes possible various thicknesses of wood to be accommodated and the arm itself carrying a wheel on the end to engage the wood and frictionally prevent the same from being kicked back because of a ratchet construction adjacent and arranged to engage with the wheel when desired.

It is one of the features of the invention that the ratchet may be disengaged at will and or the wheel itself positioned in respect to the wood being ripped in various alignments and even in a lefthanded manner so to speak for certain conditions for ripping operation.

It is also a feature to provide a spring to press the hold down arm and wheel into engagement with the wood being ripped in varying degrees so that it might not mar the wood of if the wood is very soft cause indentations therein, otherwise of course the desirability of preventing the kickback is increased by more pressure applied to the wood by the wheel and the ratchet construction involved.

With the foregoing in mind, reference is made to the drawings wherein the invention hereof is disclosed, and shown in FIG. 1 is a plan view of the device of my invention, indicating its mounting means, the hold down arm and its adjustable arrangement as well as the simplicity of the parts and relative arrangement thereof.

Figure 1:
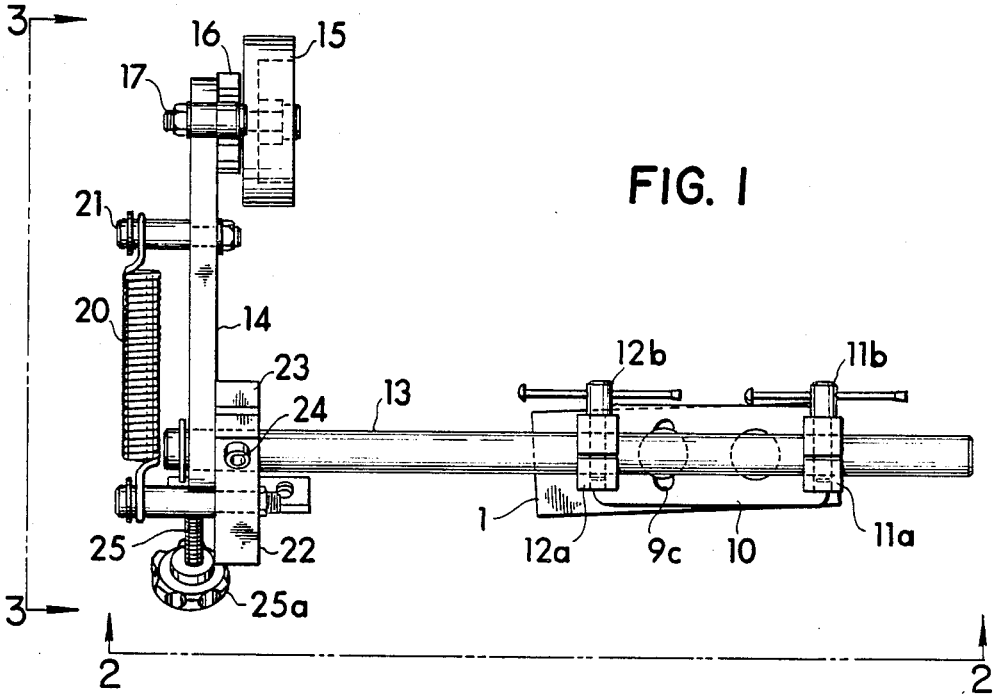
Figure 2:
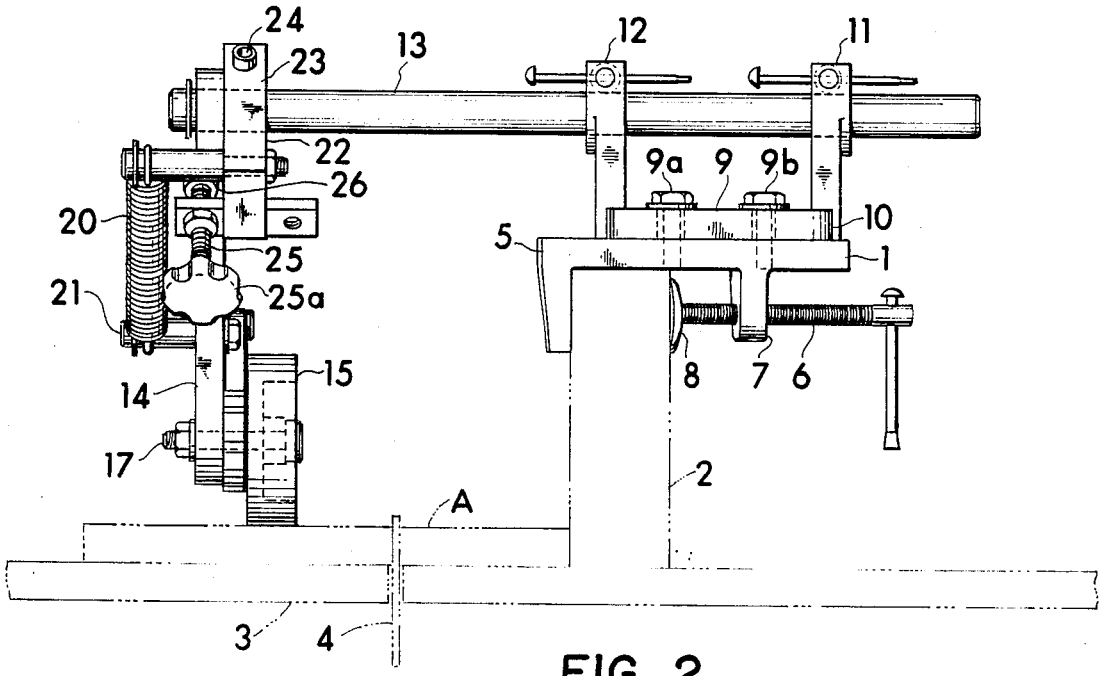
FIG. 2 is a view taken from the bottom of FIG. 1 so to speak and thus in elevation to illustrate the parts in their relationship.

Referring now to FIGS. 1 and 2 initially, a clamp bar generally designated 1 is shown in position with respect to a saw fence designated 2 which fence is positioned above a saw table such as 3 in which a circular saw 4 is operative.

The clamp bar 1 is provided with L-shaped end 5, and a clamp screw 6 extending through an arm 7 with a pressure part 8 on its end to maintain the clamp bar 1 in position on the fence 2.

The clamp bar 1 is additionally arranged so that it will support a shaft saddle 9, which is of generally U-shaped construction having a mounting means 10 from which extend upwardly the shaft supports 11 and 12.

The shaft supports 11 and 12 in turn engage a top arm shaft 13 which extends outwardly and is engaged with the shaft supports in adjustable connection by means of the clamping portions **11*a* and 12*a* as more particularly disclosed in FIG. 1 which are adjustably operated by the lock screws 11*b* and 12*b*** in a manner which will be apparent.

It is thus possible that the top arm shaft 13 can be moved inwardly and outwardly so to speak with regard to the shaft supports and positioned by the respective lock screws as will be further clearly understood, for obvious reasons, which are to position the rest of the operative elements of the device in relation to the fence as may be necessary and as will be further noted from here on.

Figure 3:
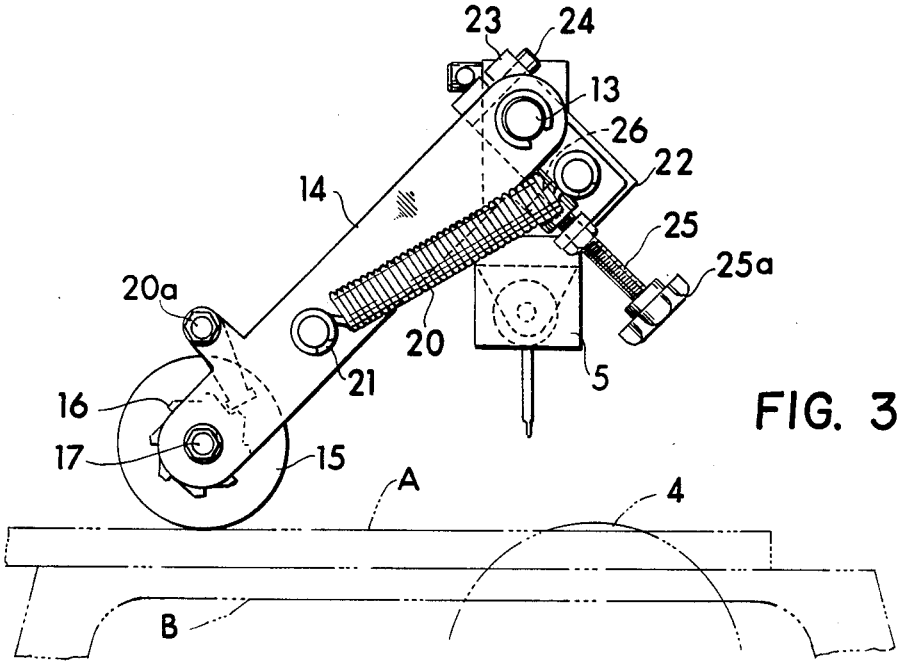
FIG. 3 is partially showing the end view of the device to illustrate the relative connection of parts and alignment as well as relationship thereof as though mounted on a saw fence and upon a saw table.
Figure 4:
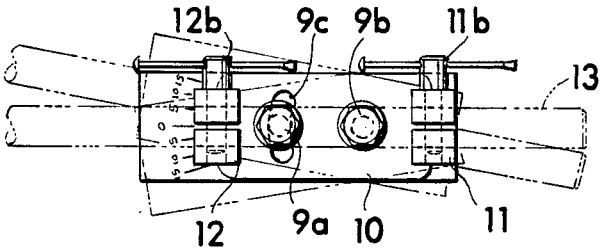
FIG. 4 is a detailed frequency view to illustrate certain adjustable aspects.

At the outer end of the shaft 13, is the hold down arm construction involving a hold down arm 14, which at its upper end more particularly disclosed in FIG. 3 is mounted on the top arm shaft 13 and the arm 14 is thus able to swing about on said shaft 13.

The hold down arm 14 is equipped at its outer end with a wheel and ratchet construction involving a wheel 15 of any preferred form but intended to have the ability to frictionally engage a material being ripped and in turn is provided with a ratchet part 16, fastened at one side of the wheel as disclosed in FIG. 1.

The wheel 15 and ratchet 16 are in turn mounted on a suitable axis 17, and in turn provided with a dog pivotally connected at 20 to an upstanding portion of the arm 14.

The dog is of the shape disclosed so that it will engage with the teeth of the ratchet 16 in the manner suggested in FIG. 3 and of course more particularly detailed in FIGS. 5 and 6 for purposes which will subsequently appear.

The arm 14 is compelled to move in a counter clockwise direction as viewed in FIG. 3 by means of a spring construction involving a tension spring 20 connected at one end 21 to the arm 14 and at the other end to what may be termed the live end adjusting block 22, the adjusting block being fixed against rotation with regard to the arm 14 by means of a suitable split end 23 and a screw 24 thereon to tighten the same on the shaft 13.

A suitable adjusting screw 25 is provided to impinge against the arm 14 at its end designated 26 so that by rotation of the screw 25 by the knob **25*a* thereon, the end 26 may impinge the arm 14 and permit more or less spring tension of the spring 20 to impact the arm 14 and thereby cause hold down more or less of the wheel 15** at the end of said arm.

Since it is often necessary to maintain the material being ripped against the fence 2 for example, it is desirable to change the alignment of rotation of the wheel 15 and to that end the shaft saddle base 9 is positioned by a pair of bolts **9*a* and 9*b* of which 9*a* is arranged in an elongated hole or opening 9*c* of the base 9 and specifically the part 10** thereof.

Thus it will be apparent that if release of the bolt **9*a* is effected, the entire structure so to speak but primarily in a shaft 13 can be moved angularly within the limits of the slot 9*c* and positioned thereby upon tightening of the bolt 9*a***.

This in turn causes the material with which the wheel 15 is engaged to be held against the fence 2 or not as the case may be and as may be desired.

Figure 6:
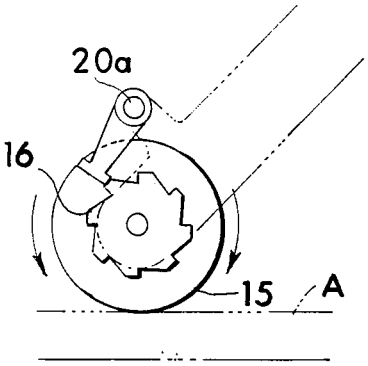

It is notable that the ratchet construction involving the ratchet dog 11 and ratchet 16, may be disabled by swinging the dog 11 into the position of FIG. 6 for example so that as the wheel rotates in a clockwise direction the dog merely skips over the teeth of the ratchet 16.

Figure 5:
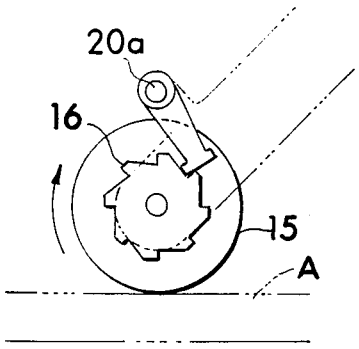
FIG. 5 is a fragmentary view showing the ratchet construction in position and as compared with FIG. 6 wherein the ratchet is out of ratcheting position so to speak.

Conversely as shown in FIG. 5 when it is desired to prevent this operation, the dog is positioned as shown therein and thus engages the teeth of the ratchet 16 to prevent reverse movement of the wood or material being ripped.

The wood for the purposes hereof is designated as A, is movable over saw table such as B for descriptive purposes and illustrative of the action of the same wherein the saw 4 is operative on the wood which is being ripped and designated A as indicated.

It should be noted that the wheel 15 may be positioned in various relationships with the arm 14 as by shifting the same to the opposite side from that disclosed in FIG. 1 or in fact the entire apparatus placed in a different position by loosening the various elements which hold the same and adjust the same and thus make the concept flexible so that it may be a free wheeling operation or a ratcheting operation so to speak in any event.

Adjustment of the spring 20 of course will provide for various degrees of tension to be exerted on the arm 14 and thus the wheel 15 engagement with the material being ripped increased or decreased as may be desired.

I claim:

1. An anti-kickback hold down device, comprising, means for mounting the device adjacent a saw means, a hold down arm carried by said mounting means for swinging support of said arm, a wheel on said arm to engage and roll along a workpiece, an element to exert downward pressure on said arm and wheel and on said workpiece, said wheel facilitating movement of said workpiece in one direction whilst in engagement with said wheel and means to prevent opposite rotation of said wheel and thus prevent movement of said workpiece in the opposite direction.

2. A device as claimed in claim 1, wherein the means to prevent opposite rotation of said wheel comprise a ratchet and a dog engaging the same.

3. A device as claimed in claim 2, wherein the dog may be positioned to permit free rotation movement of said wheel.

4. A device as claimed in claim 1, wherein the pressure element comprises a spring, and means are provided to adjust tension on said spring and thereby pressure on said arm and wheel.

5. A device as claimed in claim 1, wherein the means for mounting the device includes a clamp unit to connect the device to a fence on the saw means, a shaft saddle connected to the clamp unit, a shaft extending from the saddle, the hold down arm being mounted on the shaft, the wheel is rotatably carried at the end of the arm, and the means to prevent opposite rotation of the wheel comprise a ratchet and dog construction.

6. A device as claimed in claim 5, wherein adjustable means are provided to vary the pressure on the arm and wheel.

7. A device as claimed in claim 5, wherein the means are provided to vary the angle of the axis about which the wheel rotates to thereby vary the pressure which the wheel exerts on the workpiece to in turn press the workpiece against the fence aforesaid.

8. A device as claimed in claim 5, wherein the wheel may be positioned in different attitudes by swinging the saddle at different angles, and the wheel may be mounted on opposite sides of the hold down arm.

9. A device as claimed in claim 5, wherein the adjustable means to vary the pressure on the arm include a body mounted on the shaft and an adjusting screw operable to increase the tension on a spring connected to the arm and body.

* * * * *